US006976341B2

(12) United States Patent
Poliacek et al.

(10) Patent No.: US 6,976,341 B2
(45) Date of Patent: Dec. 20, 2005

(54) TILE INSTALLATION FIXTURE

(76) Inventors: Jiri Poliacek, 29289 Dixon, Suite #34, Hayward, CA (US) 94544; Jirina Jordan, 5339 W. 139th St., Hawthorne, CA (US) 90250

( * ) Notice: Subject to any disclaimer, the term of this patent is extended or adjusted under 35 U.S.C. 154(b) by 14 days.

(21) Appl. No.: 10/612,558

(22) Filed: Jul. 2, 2003

(65) Prior Publication Data

US 2004/0216421 A1 Nov. 4, 2004

Related U.S. Application Data

(63) Continuation-in-part of application No. 10/428,319, filed on Apr. 29, 2003.

(51) Int. Cl.[7] ..... E04F 13/08
(52) U.S. Cl. ..... 52/390; 52/384; 52/506.06
(58) Field of Search ..... 52/749.11, 747.11, 52/384, 385, 780, 456, 506.06, 386, 387, 52/177, 390; 15/238

(56) References Cited

U.S. PATENT DOCUMENTS

| | | | | |
|---|---|---|---|---|
| 3,918,222 | A * | 11/1975 | Bahramian | 52/223.7 |
| 4,744,194 | A * | 5/1988 | Yasuyoshi | 52/747.11 |
| 5,349,800 | A * | 9/1994 | Peng | 52/506.06 |
| 5,469,681 | A * | 11/1995 | Wu | 52/656.9 |
| 6,505,444 | B1 * | 1/2003 | Johnson | 52/177 |
| 6,647,684 | B1 * | 11/2003 | Gank | 52/385 |

FOREIGN PATENT DOCUMENTS

| | | | | |
|---|---|---|---|---|
| DE | 4113195 | A1 * | 4/1992 | E04B 9/24 |

* cited by examiner

*Primary Examiner*—Naoko Slack
(74) *Attorney, Agent, or Firm*—Cislo & Thomas LLP

(57) ABSTRACT

A lattice of support surfaces are used to support substantially the perimeter of a construction tile. The support surface is made integral with a decorative border. Linear railways attach orthogonally to other railways to form the lattice. Tiles are set into the lattice providing a warmer installation relative to installation over concrete tile foundation.

2 Claims, 9 Drawing Sheets

TILE INSTALLATION FIXTURE

RELATED APPLICATIONS

This present application is continuation-in-part of application Ser. No. 10/428,319 filed on Apr. 29, 2003 entitled "METHOD AND APPARATUS FOR FLOATING INSTALLATION OF TILES", by Poliacek, currently pending, for which the priority date for this application is hereby claimed and which is incorporated herein by reference in its entirety.

FIELD OF THE INVENTION

This invention relates generally to tile and masonry installation, and specifically to a method and framework for installing tiles.

BACKGROUND OF THE INVENTION

The building industry has long used various types of tiles in construction projects. Tiles come in many forms and are manufactured from various types of materials, in a wide variety of colors and surface textures. For example, ceramic tile is often used in bathroom applications. Marble tile is often used for flooring and other decorative applications.

Better techniques for installation of tiles have evolved over time. In fact, many patents that describe installation techniques have been granted. Most of these evolutions in tile installation techniques have been developed in response to the inadequacy of former installation methods. One common problem with installation of any tile is the fact that individual tiles need to be aligned relative one to another. In response to this problem, prior art methods for installation of tile include methods where spacers are introduced between individual tiles in order to ensure uniform tile installation. In fact, all of the known art addresses this major problem. Various techniques for the installation of tile spacers have been devised including the use of a pre-fabricated lattice that can be placed on an installation surface. Once the pre-fabricated lattice is installed, individual tiles may be secured into the lattice resulting in a clean, uniform installation. Of course, all of these prior art methods require the use of a mortar in order to secure an individual tile to the installation surface. Additional mortar (i.e. "grout") is then used to fill the interspatial gap in between individual tiles.

These prior art methods fail to address some other major problems associated with the installation of tile in typical construction applications. One such problem is the need to easily replace an individual tile if it were to be inadvertently damaged. Yet another problem is that all known tile installation techniques apply an individual tile to a installation surface that is, in many cases, a cold concrete slab. Hence, a tile floor constructed according to conventional wisdom results in a cold, heat-sunk surface.

SUMMARY OF THE INVENTION

As already introduced in the incorporated reference, the present invention is a method for installing tiles in floating manner above the floor. The method comprises providing a support within the footprint of and proximate to the outer perimeter of a tile. A first border is provided along one edge of the tile and a second border is provided along the second edge of the tile wherein the two edges are substantially orthogonal to each other. The present method is further distinguished by the provision of maintaining the first border in place relative to the second border.

In order to maintain the position of the first border relative to the second border, one alternative method provides for connecting a first end of the first border to a cross-tie. Then, a second border is orthogonally connected to the cross-tie. According to the method, the first border is maintained in position relative to the second border by mating a first connector of a first type that is associated with the first border to second connector of a second type that associated with the second border.

In order to provide a generally pleasing aesthetic appearance, a fascia is provided between the first border and the second border. According to an exemplary method, the fascia is provided by extending the first border to a tapered transition line and also extending the second border to the same tapered transition line.

The present invention also comprises a tile installation fixture comprising a support rail, a border and a first connector substantially at one end of the support rail. According to one alternative embodiment, the first connector comprises a connector that is compatible with a cross-tie. According to one alternative embodiment of the present invention, the border extends beyond the support rail. According to yet another example, this extension of the border continues to an imaginary tapered extension line that extends outward and away from the end of the support rail. The support rail itself, according to an exemplary embodiment comprises a ledge that runs along the border and that is lower in elevation than the border. The installation fixture border comprises a raised surface that runs along the support rail.

According to an alternative example exemplary embodiment of the invention, the first connector comprises a right-angle connector of a first type. According to yet another exemplary embodiment, the tile installation fixture further comprises a second right-angle connector of a second type. This second type connector is complementary to the first type so as to enable the two connectors to mate. When so mated, the support rail and border of a first tile installation fixture is set substantially orthogonal to the support rail and border of a second tile installation fixture.

BRIEF DESCRIPTION OF THE DRAWINGS

The foregoing aspects are better understood from the following detailed description of one embodiment of the invention with reference to the drawings, in which.

DETAILED DESCRIPTION OF THE INVENTION

Figure 1:
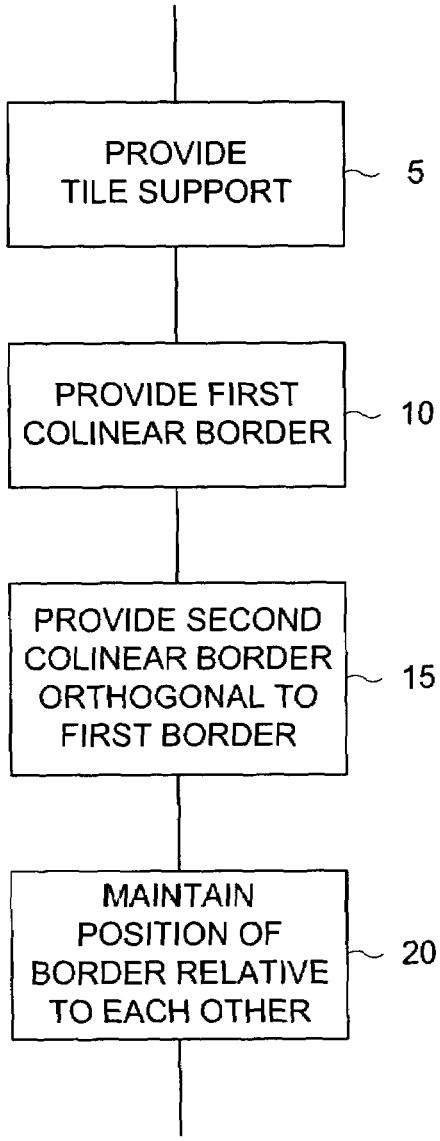
FIG. 1 is flow diagram that depicts an exemplary method for installing a floor tile according to the present invention.

FIG. 1 is flow diagram that depicts an exemplary method for installing a floor tile according to the present invention. A tile support is provided (step 5) within the footprint of the tile is generally proximate to the outer perimeter of the tile. Once the support has been provided, a first border is provided along a first edge of the tile (step 10). Generally, this border is collinear to the support. Once the first border is provided, a second border is provided along a second edge of the tile. This second edge of the tile is substantially orthogonal to the first edge. However, the tile need not be rectangular. Hence, additional variations of this method may provide a second border at some other angle relative to the first border. In order to ensure a secure installation of the tile, one example of alternative method of the present invention provides for maintaining the position of the first border relative to the position of the second border (step 20).

Figure 2:
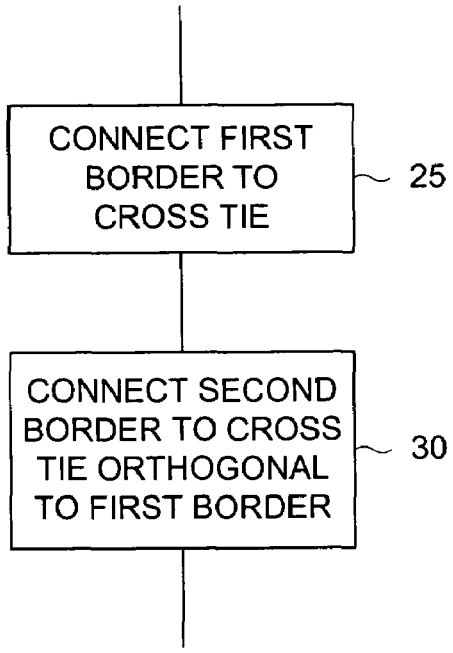
FIG. 2 is a flow diagram that depicts an exemplary method for maintaining the position of a second border relative to a first border according to the present invention.

FIG. 2 is a flow diagram that depicts an exemplary method for maintaining the position of a second border relative to a first border according to the present invention. According to one alternative method, maintaining the position of the first border relative to the second border is accomplished by connecting a first end of the first border to a cross-tie (step 25). A first end of the second border is also attached to the cross-tie (step 30). Typically, the second border is attached to cross-tie in a manner that renders it orthogonal to the first border.

Figure 3:
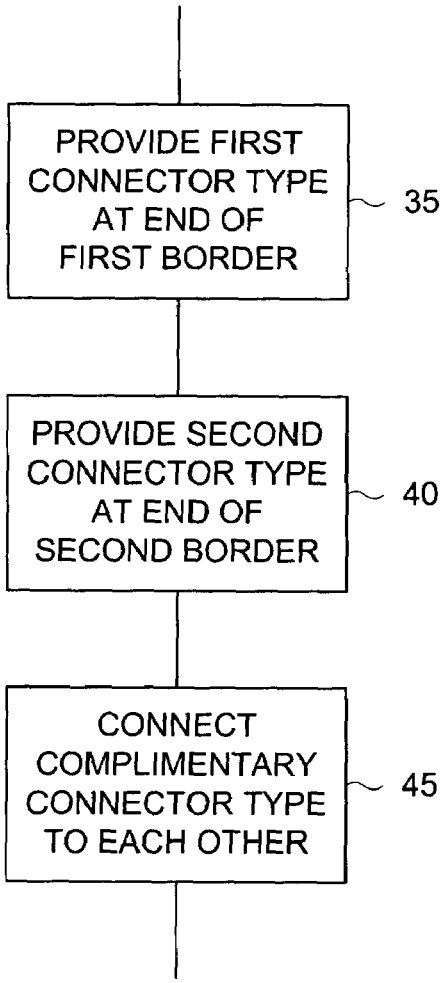
FIG. 3 is a flow diagram that depicts one alternative method for maintaining the position of a second border relative to a first border according to the present invention.

FIG. 3 is a flow diagram that depicts one alternative method for maintaining the position of a second border relative to a first border according to the present invention. According to one alternative method, a first end of the first border is directly attached to a first end of the second border. And according to yet another alternative method, this is accomplished by providing a first connector at the first end of the first border (step 35) and a second connector at the first end of the second border (step 40) wherein the first connector provided on the first border is complementary to the second connector provided on the second border. The two connectors are then connected (step 45), resulting in securing the position of the second border relative to the first border, typically in orthogonal manner.

According to one alternative method of the present invention, a facia is provided between the first border and the second border. According to an exemplary method, the facia is provided by extending the first border to taper transition line content extending the second border to the same taper transition line. According to another exemplary method of the present invention, providing a support within the footprint of the tile comprises providing a ledge along the first border. According to yet another variation of the present method, providing a border along the tile comprises providing a raised surface along the support ledge. The reader is encouraged to review the Incorporated reference for further clarification on this exemplary method of providing either a ledge and/or a border along an edge of a tile.

Figure 4:
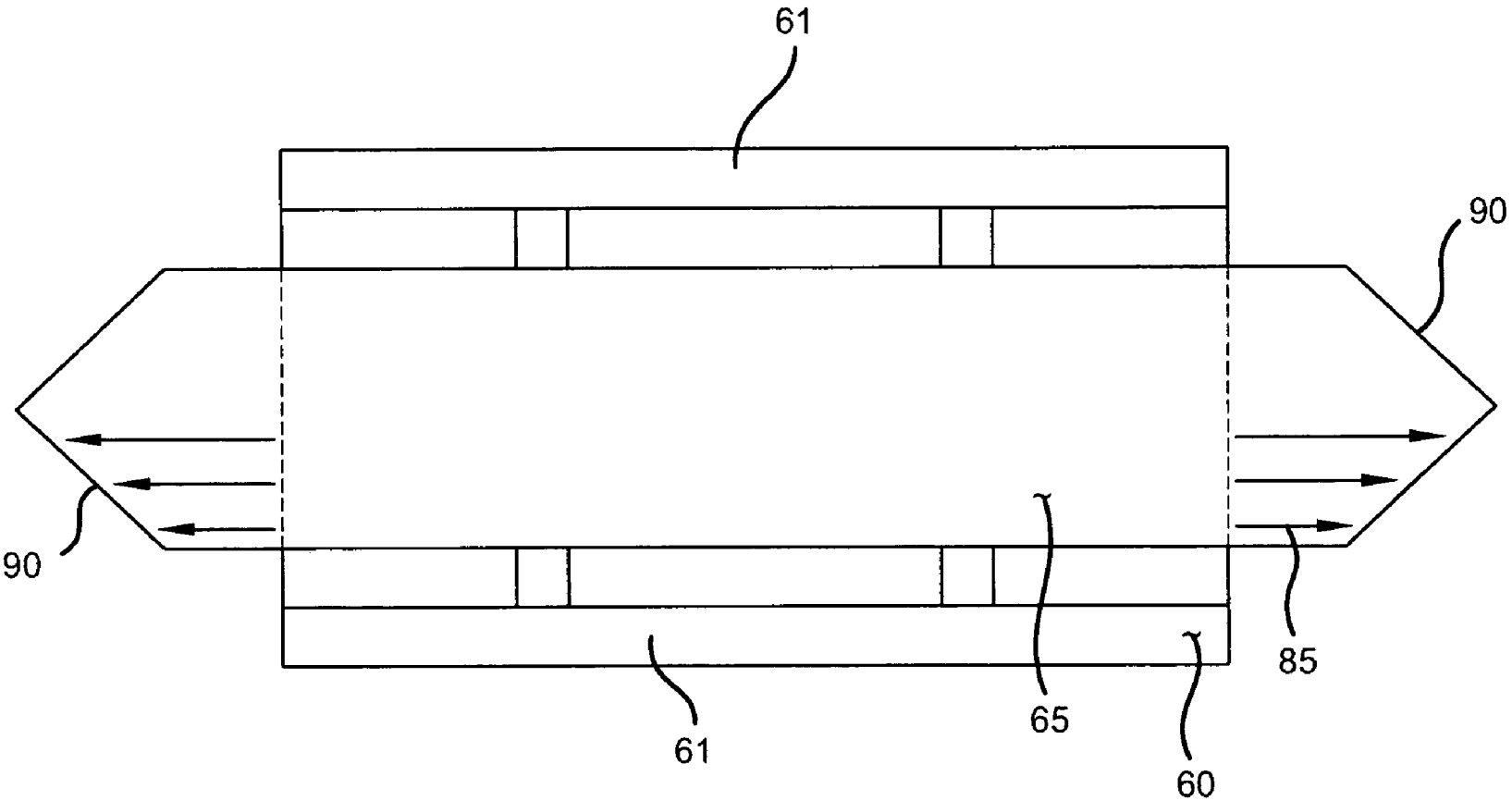
FIGS. 4 and 5 are a top of view and a perspective view, respectively, of a tile installation fixture that implements one alternative method of the present invention for connecting borders orthogonal to each other by means of a cross-tie.
Figure 5:
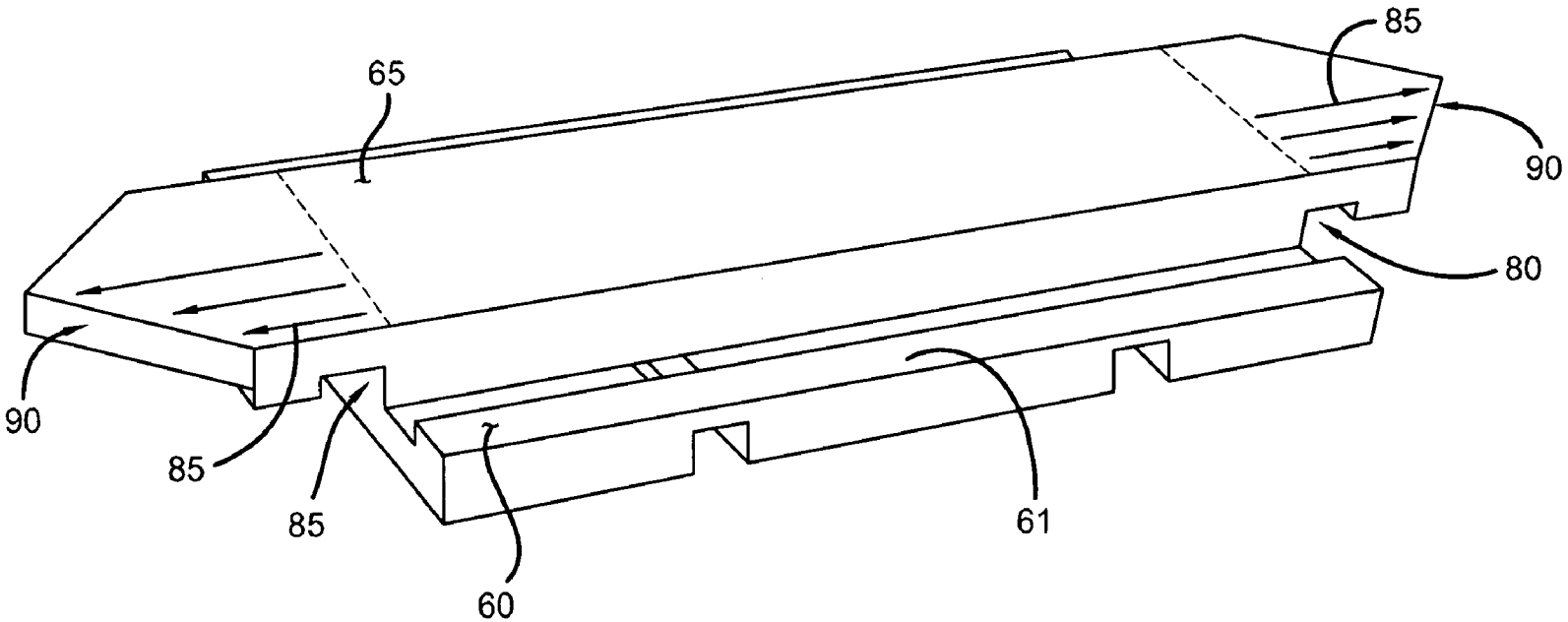

FIGS. 4 and 5 are a top of view and a perspective view of a tile installation fixture that implements one alternative method of the present invention for connecting borders orthogonal to each other by means of a cross-tie. According to this exemplary embodiment, a tile installation fixture comprises a support rail 60 and a border 65 disposed collinearly to the support rail 60. The tile installation fixture further comprises a connector 80 at one end. According to an exemplary embodiment, connector 80 is compatible with a cross-tie. It should be noted that, according to one alternative embodiment support rail 60 comprises a ledge 61 that runs along border 65 wherein ledge 61 is lower in elevation than border 65. According to yet another alternative embodiment, border 65 comprises a raised surface that runs along support rail 60.

According to yet another exemplary embodiment of the present invention, border 65 is extended outward beyond support rail 60, as generally shown by extensions 85 in FIG. 5. Extension 85 continues to an imaginary tapered extension line 90. This same treatment, including the connector and border extension, may be provided on both ends of the tile installation fixture according to yet another alternative embodiment of the invention.

Figure 6:
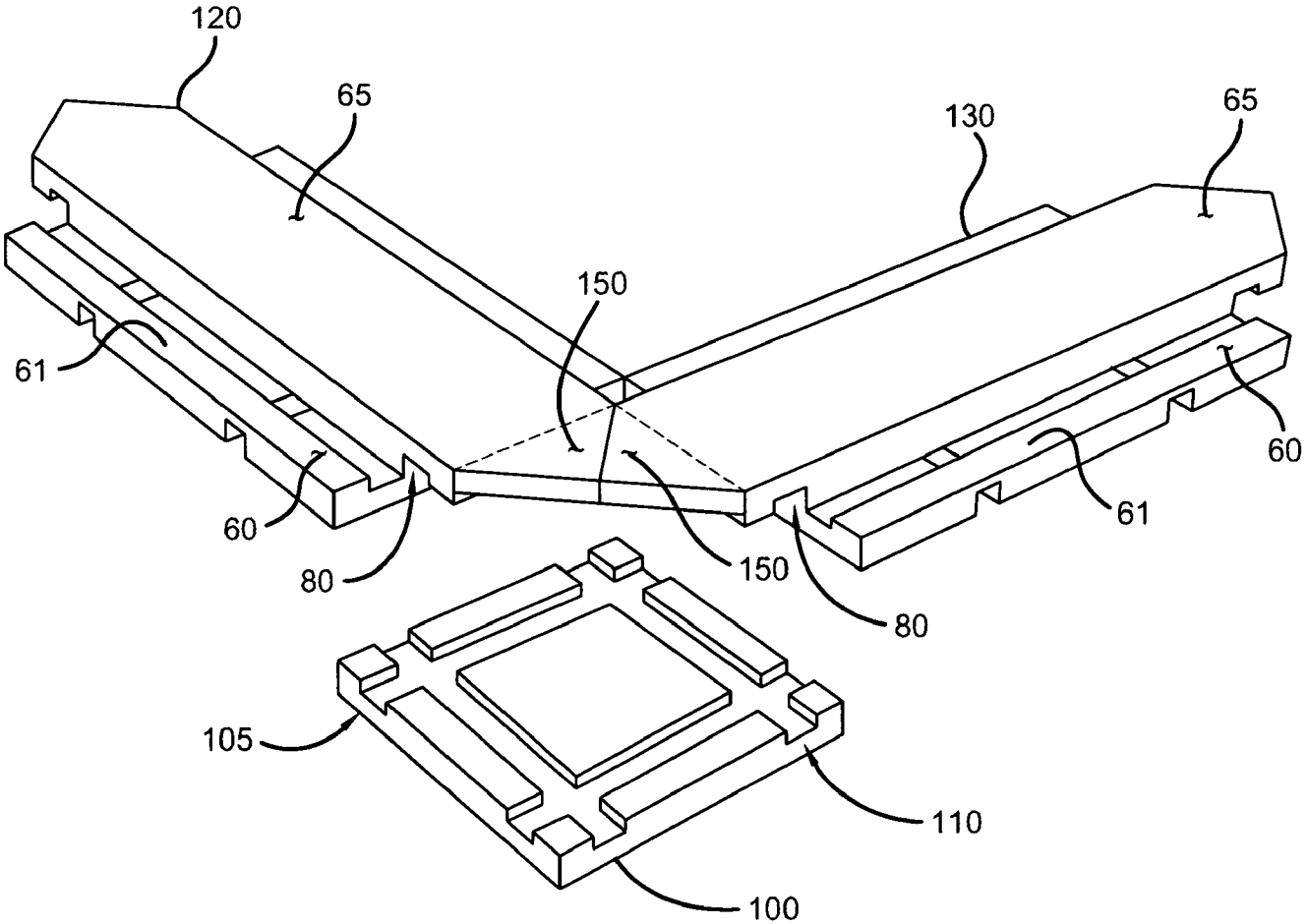
FIG. 6 is a pictorial representation that depicts a connection of a first border and a second border as facilitated by the use of a cross-tie according to the present invention.

FIG. 6 is a pictorial representation that depicts a connection of a first border and a second border as facilitated by the use of a cross-tie according to the present invention. According to one illustrated use case, a first tile installation fixture 120 is connected to a cross-tie 100 by means of a connector 80 comprising one end of the first tile installation fixture 120. A second tile installation fixture 130, also including a connector 80 at one end, is connected to the same cross-tie 100. The cross-tie 100, according to an exemplary embodiment, comprises a plurality of tile installation fixture connectors. According to this embodiment, at least two such connectors (105 and 110) comprise the cross-tie 100. These connectors, comprise tongue and groove connectors that are complementary to tongue and groove connectors 80 comprising the tile installation fixtures. Note, that according to this embodiment, the facia 150 provided between the two borders comprises extensions of these two borders to an imaginary tapered line 90.

Figure 7:
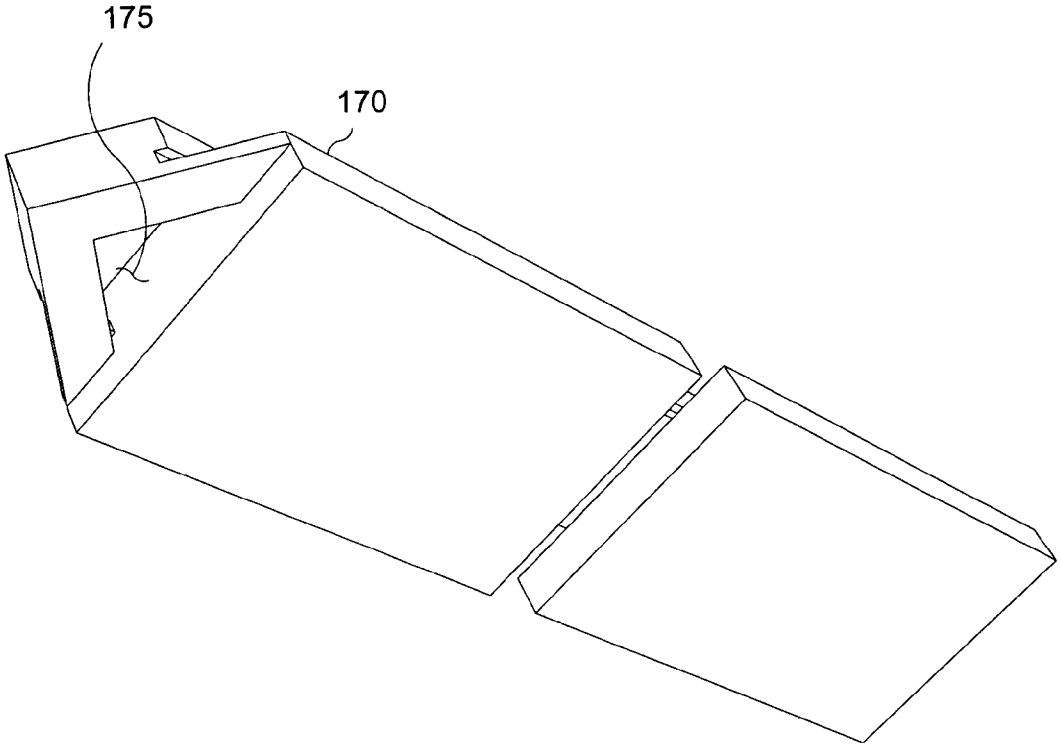
FIG. 7 is a perspective diagram that depicts the underside of one alternative embodiment of a tile installation fixture comprising a first connector type according to the teachings of the present method.

FIG. 7 is a perspective diagram that depicts the underside of one alternative embodiment of a tile installation fixture comprising a first connector type according to the teachings of the present method. According to this embodiment, a tile installation fixture 170 comprises a first connector type. According to this embodiment, the first connector type comprises a receptacle 175 having an opening oriented downward relative to the installation position of tile installation fixture 170. According to this embodiment, receptacle 175 comprises a triangular shaped opening that is capable of accepting at least one prong. Generally, this prong comprises a second and complementary connector type comprising yet another embodiment of the tile installation fixture.

Figure 8:
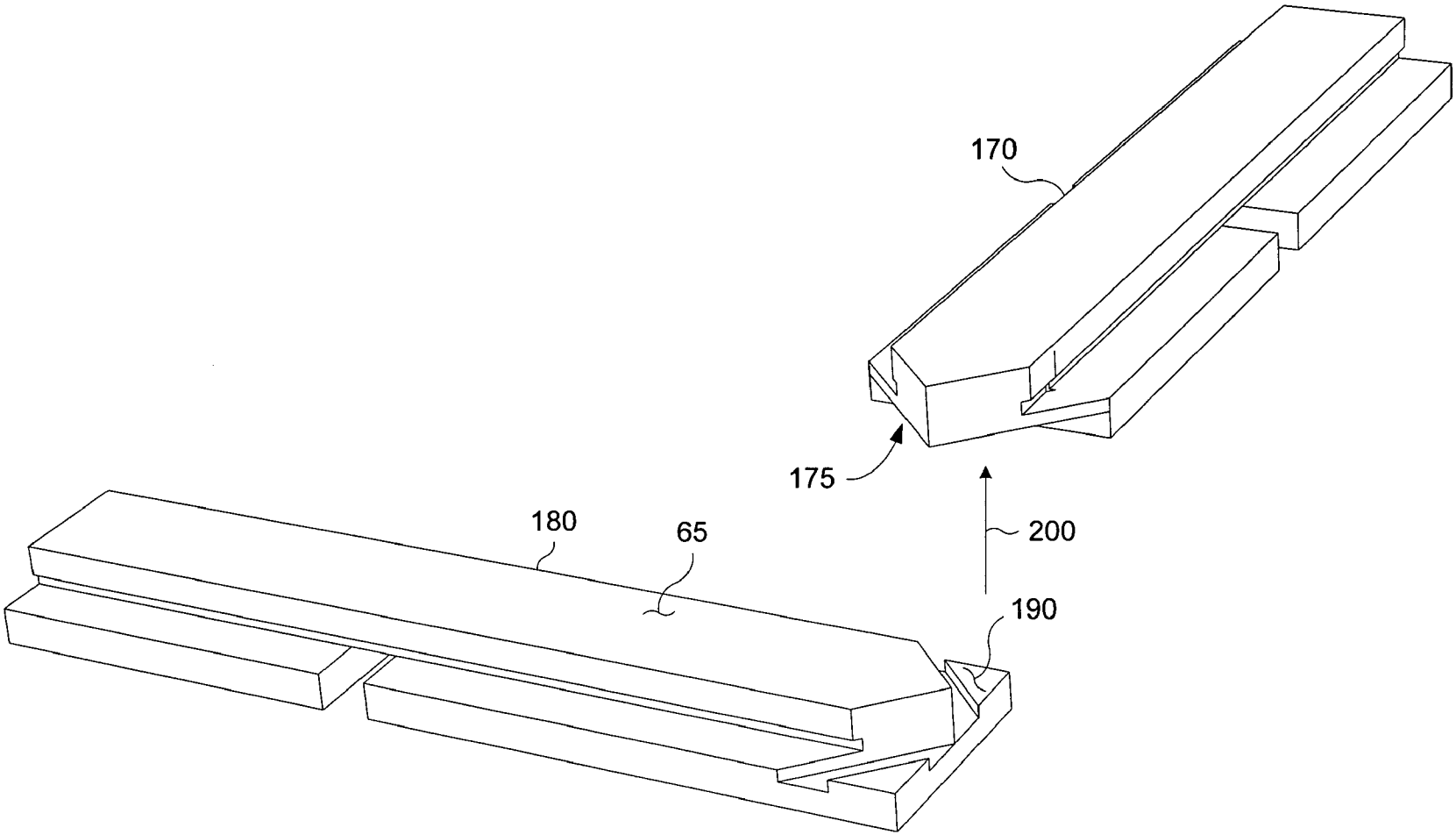
FIG. 8 is a perspective diagram that depicts the direct connection of a first tile installation fixture to a second tile installation fixture according to the teachings of the present invention.

FIG. 8 is a perspective diagram that depicts the direct connection of a first tile installation fixture to a second tile installation fixture according to the teachings of the present invention. According to an exemplary embodiment of the present invention, a first end of a second tile installation fixture 180 comprises a second connector type. According to this embodiment, the second connector type comprises a prong 190 that is compatible with the receptacle 175 of a first tile installation fixture 170.

Figure 9:
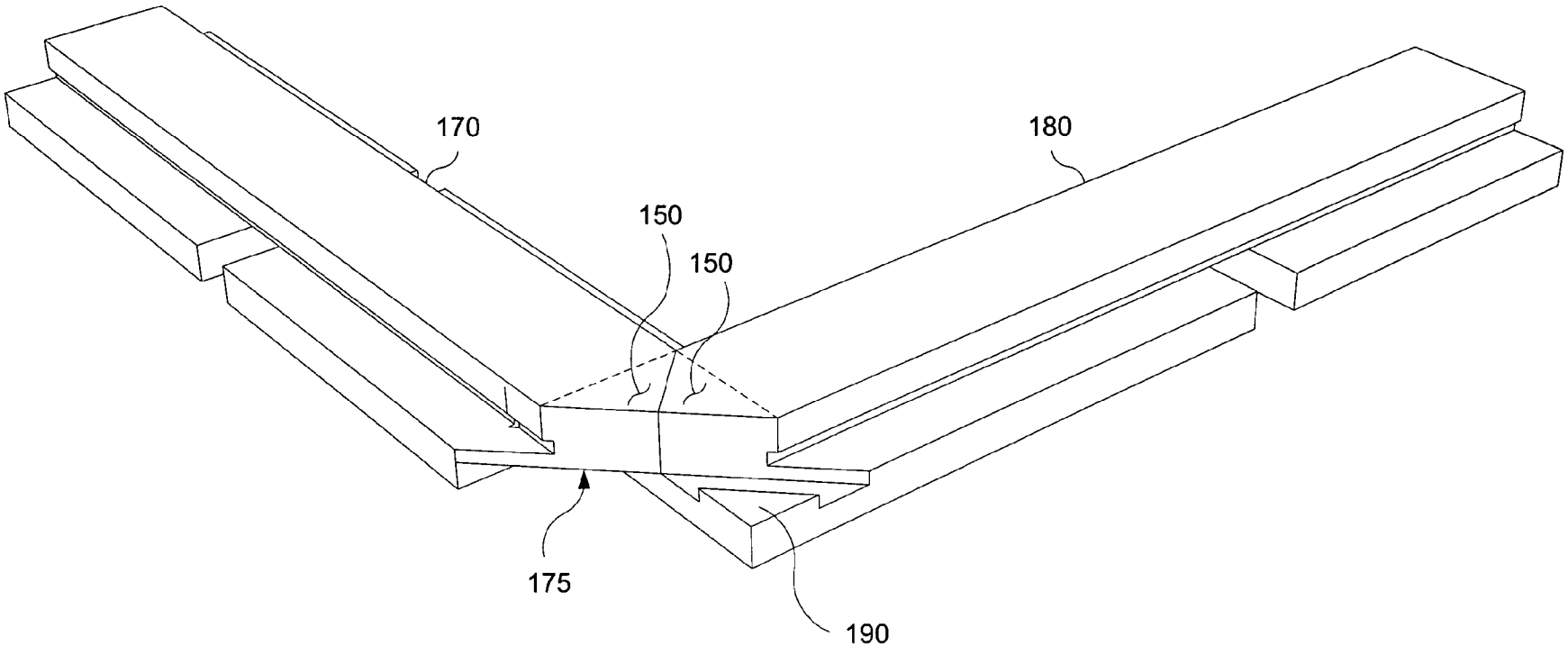
FIG. 9 is a prespective view depicting the direct attachment of a first border to a second border by means of complementary connectors.

FIG. 9 is a perspective diagram that depicts the direct attachment of a first border to a second border by means of complementary connectors comprising each of said borders. According to this illustrative use case, first tile installation fixture 170 is directly attached to a second tile installation fixture 180. The first tile installation fixture includes a first connector type, for example receptacle 175 (not specifically visible in this figure) and the second tile installation fixture 180 comprises a second connector type that is complementary to the first connector type. According to an exemplary embodiment, the second connector type comprises a prong 190. As the two tile installation fixtures are connected to each other, extensions to their respective borders 150 form a fascia between the two borders.

ALTERNATIVE EMBODIMENTS

While this invention has been described in terms of several preferred embodiments, it is contemplated that alternatives, modifications, permutations, and equivalents thereof will become apparent to those skilled in the art upon a reading of the specification and study of the drawings. It is therefore intended that the true spirit and scope of the present invention include all such alternatives, modifications, permutations, and equivalents.

What is claimed is:

1. A tile installation fixture, comprising:

a tile support rail; and a border disposed collinearly with said tile support rail, said tile support rail being lower in elevation than said border, said border incorporating a raised surface adapted to run along said tile support rail and at least one substantially tapered fascia extension projecting beyond said tile support rail, said at least one substantially tapered fascia extension including on one side a receptacle connector of a substantially triangular configuration.

2. The tile installation fixture of claim 1, wherein said substantially triangular receptacle connector is adapted to mate with a connector prong on a complementary tile installation fixture.

* * * * *